United States Patent [19]

Abels

[11] Patent Number: 4,754,688

[45] Date of Patent: Jul. 5, 1988

[54] FLICK RAMMER FOR ARTILLERY ROUNDS

[75] Inventor: Frank Abels, Munster, Fed. Rep. of Germany

[73] Assignee: Wegmann & Co. GmbH, Kassel, Fed. Rep. of Germany

[21] Appl. No.: 17,513

[22] Filed: Feb. 24, 1987

[30] Foreign Application Priority Data

Mar. 4, 1986 [DE] Fed. Rep. of Germany ..... 3607006

[51] Int. Cl.[4] ..... F41F 9/06; F41F 17/16

[52] U.S. Cl. ..... 89/47

[58] Field of Search ..... 89/45, 47, 1.805, 33.05

[56] References Cited

U.S. PATENT DOCUMENTS

| | | | |
|---|---|---|---|
| 2,399,722 | 5/1946 | Cotter et al. | 89/47 |
| 3,029,707 | 4/1962 | Christiansson | 89/47 |
| 3,296,931 | 1/1967 | Christiansson | 89/47 |
| 3,507,184 | 4/1970 | Prybyla | 89/47 |
| 3,602,089 | 8/1971 | Beaufrere | 89/47 |
| 3,938,421 | 2/1976 | Nordmann | 89/47 |
| 4,388,854 | 6/1983 | Dabrowski et al. | 89/47 |

FOREIGN PATENT DOCUMENTS

| | | | |
|---|---|---|---|
| 559190 | 3/1957 | Italy | 89/45 |
| 865 | of 1909 | United Kingdom | 89/45 |

*Primary Examiner*—Stephen C. Bentley
*Assistant Examiner*—Stephen M. Johnson
*Attorney, Agent, or Firm*—Sprung Horn Kramer & Woods

[57] ABSTRACT

A flick rammer for artillery rounds. The rammer has a loading tray that is positioned in alignment with the powder chamber at a prescribed distance to the rear of the gun. The tray accommodates the round. The rammer also has a mechanical acceleration component that engages the rear of the round and is connected to a cylinder-type drive mechanism. To improve the device to the extent that ramming will remain rapid whereas the design will be simple enough to operate reliably even at light loads and to occupy very little space, the cylinder-type drive mechanism is a pneumatic cylinder that communicates with a compressed-air reservoir through a rapid-opening control valve, and the mechanical acceleration component is connected to the moving component of the pneumatic cylinder through a stroke-transmission mechanism with a transmission ratio greater than 1.

5 Claims, 3 Drawing Sheets

FLICK RAMMER FOR ARTILLERY ROUNDS

BACKGROUND OF THE INVENTION

The present invention relates to a flick rammer for artillery rounds with a loading tray that is positioned in alignment with the powder chamber at a prescribed distance to the rear of the gun and accommodates the round and with a mechanical acceleration component that engages the rear of the round and is connected to a cylinder-type drive mechanism.

Loading an artillery weapon involves thrusting a shell, which may weigh 50 kg or more, far enough into the barrel at a speed of at least 1.5 m/sec to force the soft-metal positioning ring of the shell into the conical section of the powder chamber. The force must be powerful enough to prevent the round from dropping out due to its inherent weight even when the barrel is at maximum elevation, while simultaneously sealing off the front of the powder chamber.

Most known armored-vehicle rounds today are rammed manually by the crew. The barrel is appropriately positioned and the shell manually inserted into the powder chamber and thrust all the way in by the maximum exertions of two or three men with a ramrod. The drawback to this method is that the barrel has to be moved out of firing alignment while the gun is being loaded which is time consuming and requires re-aiming. This method of loading is also very labor-intensive and involves a lot of physical exertion on the part of the crew. Thus, the obtainable rates of fire are not adequate for contemporary warfare.

Various devices intended for eliminating the need for manual loading are known.

The device called a "chain rammer" employs two chains wound on a drum. The chains are united by a special mechanism in such a way that they hook together and become very rigid. The united chains emerge from the mechanism more or less in the form of a rod and can be employed to ram in the rounds. The major drawback to this known device, aside from the expense of the drive mechanism, is its relatively low ramming rate, which results from the necessity of extracting the chains from the powder chamber once the round has been rammed in.

Also known are rack-and-pinion rammers, which operate similarly to chain rammers. A drive mechanism advances a rack that rams in the round. The major drawback to this device is that it requires a lot of space at the rear of the gun to accommodate the rack and that much space is almost never available in armored vehicles.

Also known are telescoping rammers, wherein the round is rammed in with a telescoping pneumatic cylinder positioned at the rear of the gun. Although this device is more appropriate for integration into armored vehicles, it also involves the drawback of being very slow, consuming in particular a lot of valuable time in restoration.

Finally, what are called "flick rammers" are known. This type of rammer operates on the principle of accelerating a shell that is still outside the gun so powerfully that, once it leaves the acceleration system, it will fly freely into the powder chamber without being forced by any type of rod.

The acceleration in known flick rammers is obtained with either a tensioned spring or a controlled hydraulic cylinder.

One of the advantages of a flick rammer is the high speed at which the ramming is carried out, whereby in particular no time is lost in retracting it from the powder chamber. Known flick rammers, however, have one essential drawback. They involve too many controls, valves, and compression and equalization reservoirs in the hydraulic and mechanical systems. This decreases their reliability and takes up too much space inside the vehicle. Flick rammers that depend on springs also entail the problem that the spring cannot be tensioned enough when the charge is too small.

SUMMARY OF THE INVENTION

The point of departure for the present invention is a flick rammer of the aforesaid type. The object of the invention is to improve the device to the extent that ramming will remain rapid whereas the design will be simple enough to operate reliably even at light loads and to occupy very little space.

This object is attained in accordance with the invention by the improvement wherein the cylinder-type drive mechanism is a pneumatic cylinder that communicates with a compressed-air reservoir through a rapid-opening control valve, and a mechanical acceleration component is connected to moving component of the pneumatic cylinder through a stroke-transmission mechanism with a transmission ratio greater than 1.

The theory behind the invention is that of generating the force needed to accelerate the round (app. 5000 Nm) by means of a pneumatic cylinder. Since powerful forces must be made available very rapidly when ramming artillery shells, and since precision is not essential, a pneumatic system is much superior to a hydraulic system. An especially large pneumatic cylinder with a short stroke can be employed to generate the force needed to accelerate the round.

The stroke of the cylinder can be transmitted by the stroke-transmission mechanism, with the transmission ratio being at least 5:1, for example. The pneumatic cylinder can be large enough to ensure that the force available at the point where the round is engaged will be powerful enough (app. 5000 Nm) in spite of the high transmission ratio. Since it is important to move the pneumatic cylinder especially rapidly, so that the normal slow pressure build-up inside it is irrelevant, a compressed-air reservoir can also, in accordance with the invention, be positioned upstream of the cylinder which communicates with the reservoir through a rapid-opening control valve that has an especially large cross-section.

It will in this connection be an advantage if the compressed-air reservoir and pneumatic cylinder are designed such that the supply pressure in the compressed-air reservoir is high enough above the maximum permissible cylinder pressure and that, once the control valve has opened and the same pressure prevails in both the reservoir and the cylinder, that pressure will be the maximum permissible cylinder pressure. The pneumatic cylinder will accordingly always operate at its maximum possible force and speed over its total stroke, independently of what pressure is applied. Consequently, in conjunction with the appropriate transmission ratio of approximately 5:1, the acceleration component can be accelerated powerfully enough to start a 50-kg artillery shell resting against it at a speed of 7 m/sec. That starting speed is obviously sufficient to ram the round into the powder chamber no matter what position the barrel is in.

The mechanical acceleration component can be the free end of a pivoting ramming lever that is secured at a prescribed coupling point to the moving component of the pneumatic cylinder, with the ratio of the distance of the free end of the lever from its pivot to the distance of the coupling point from the pivot dictated by the transmission ratio.

The coupling point of the ramming lever can be positioned in a plane perpendicular to the longitudinal axis of the loading tray and between the front and rear end of the tray at a prescribed distance from that axis, and the ramming lever can extend out of that plane into another plane perpendicular to the longitudinal axis of, and behind, the tray and have a section in the vicinity of its free end that extends essentially within the second plane.

The ramming lever can be secured to the moving component of the pneumatic cylinder by means of a tie rod and an articulation.

The pneumatic cylinder can be positioned in relation to the ramming lever in such a way that, when the cylinder moves, it will apply tension to the tie rod.

The pneumatic cylinder can be a diaphragm cylinder

The advantages of the flick rammer in accordance with the invention will now be summarized.

(a) Its ramming rate is definitely higher than that of a hydraulic or spring-loaded rammer.

(b) The design of the overall system is much simpler than those of known systems in that it requires only one compressed-air reservoir, one pneumatic cylinder, and one valve, whereas all previously known devices have many more necessary subassemblies.

(c) In contrast to hydraulic systems that employ a toxic, aggressive, and combustable hydraulic fluid at 120–150 bars and temperatures of more than 100° C. the rammer in accordance with the invention employs compressed air at approximately 16 bars, which does not endanger the crew.

(d) Since the system in accordance with the invention employs compressed air, small leaks are insignificant because no fluid that would have to be replaced is lost and because leakage does not result in toxicity, fire hazard, or corrosion.

(e) The repair of pneumatic systems, the replacement of lines for example, is simple (only air having to be drained e.g.).

(f) A pneumatic flick rammer can if necessary be operated directly from a cannister of compressed air carried along in the vehicle as a spare when the central controls and power supply are down. The rammer can accordingly continue operating in an emergency.

(g) The output of a pneumatic flick rammer does not depend on the particular charge employed.

Some preferred embodiments of the invention will now be specified with reference to the attached drawings, wherein:

DETAILED DESCRIPTION OF THE PREFERRED EMBODIMENTS

Figure 1:
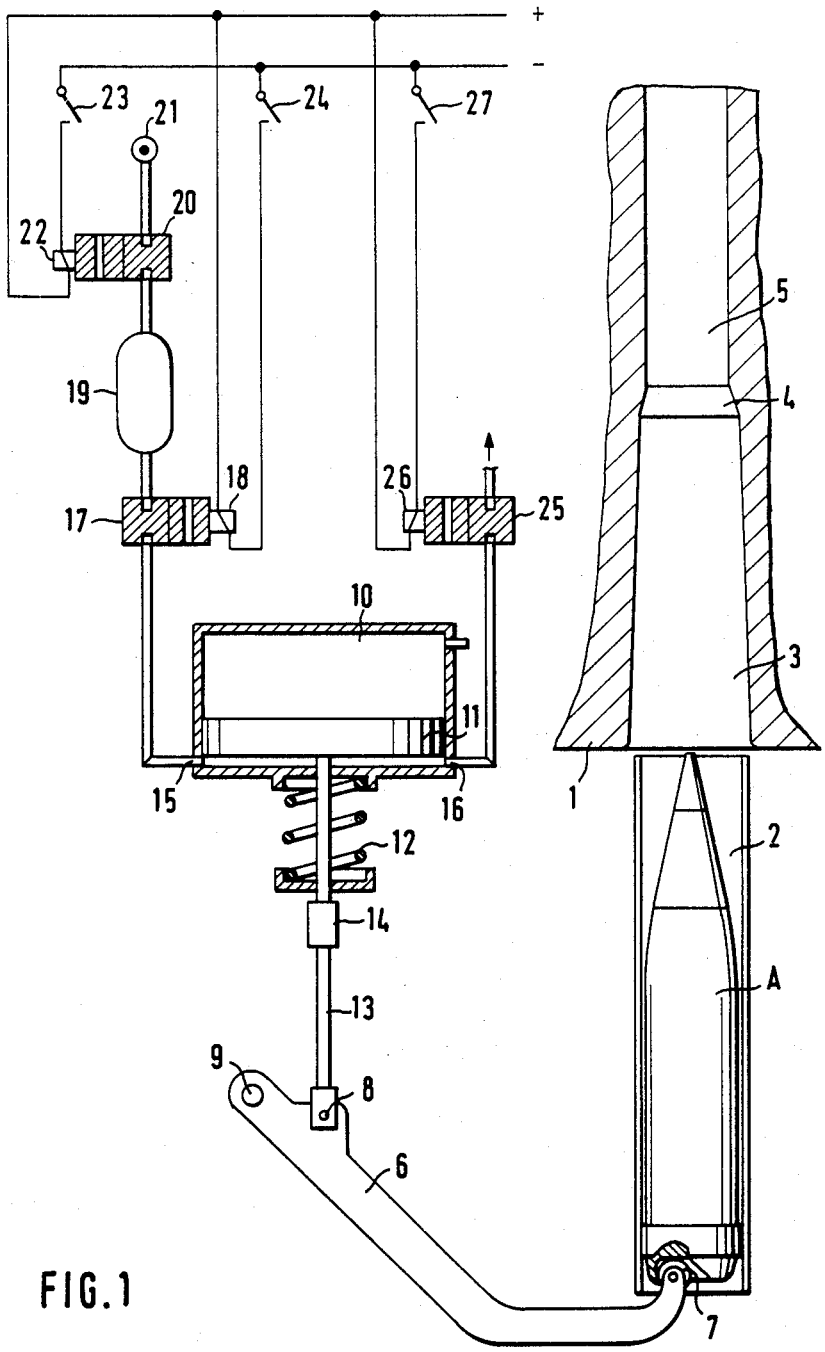
FIG. 1 illustrates, partly in the form of a circuit diagram, a flick rammer according to the invention just before being activated.
Figure 2:
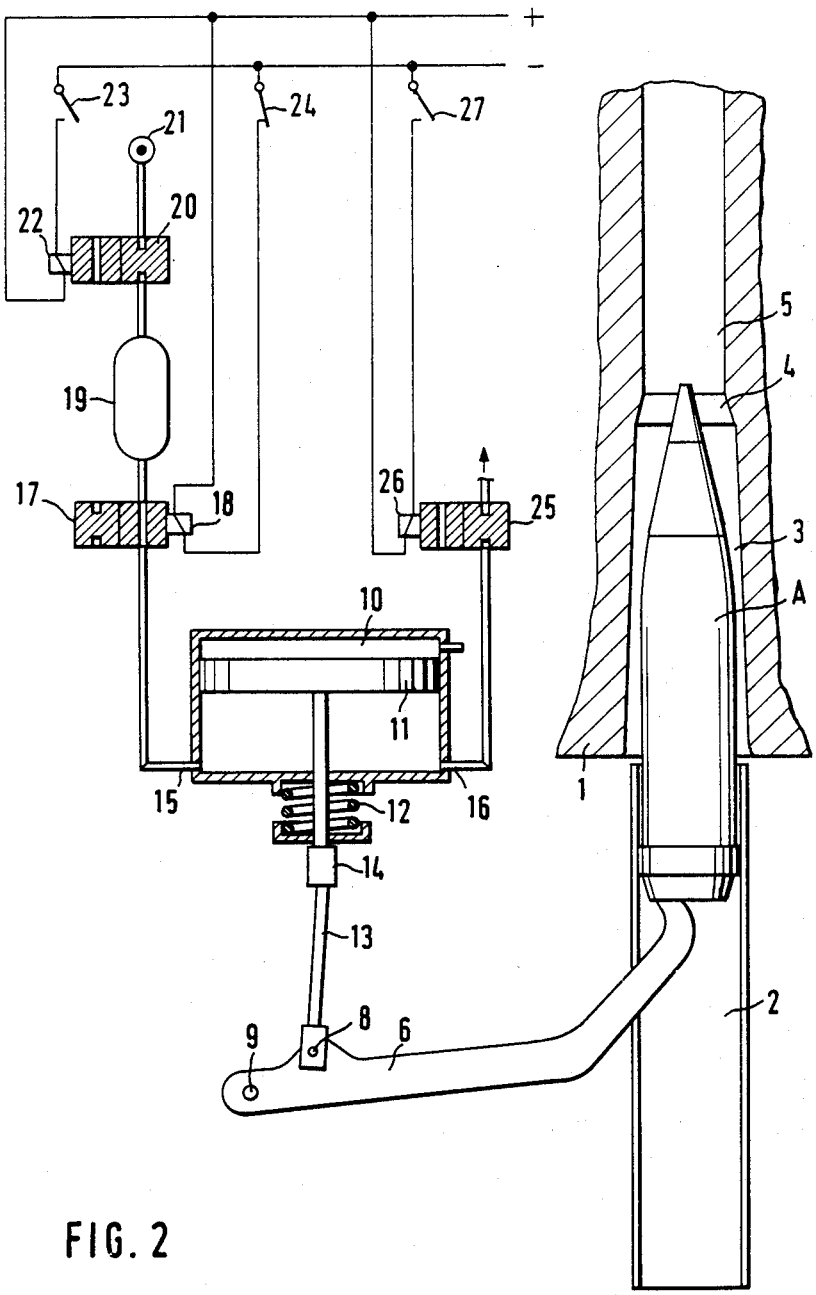
FIG. 2 shows the flick rammer illustrated in FIG. 1 while the round is being accelerated.
Figure 3:
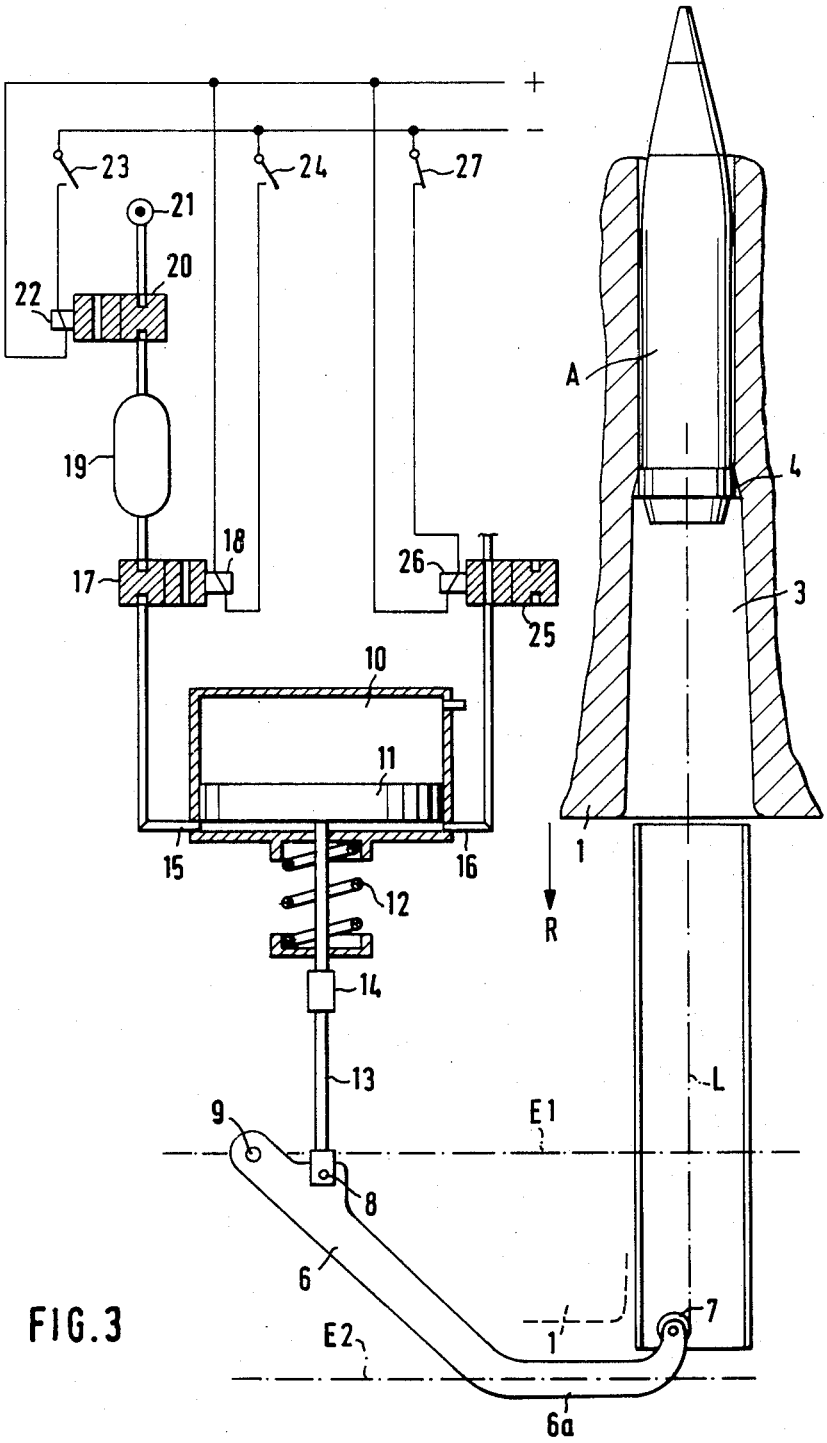
FIG. 3 shows the flick rammer subsequent to the termination of the ramming procedure.

FIGS. 1 through 3 are highly schematic illustrations of the rear end 1 of a barrel. A flick rammer associated with the barrel has a loading tray 2 aligned with the powder chamber 3 of the barrel. A round A can be placed in loading tray 2. The actual, rifled and landed, barrel 5 extends forward from powder chamber 3 through a conical section 4.

The flick rammer also has a ramming lever 6 that pivots on a pivot 9. A positioning roller 7 on the free end of the lever engages the base of a round A in loading tray 2. A tie rod 13 is secured to ramming lever 6 at a coupling point 8 between pivot 9 and the free end of the lever. Tie rod 13 is also secured to a piston 11 at an articulation 14. Piston 11 is associated with a pneumatic cylinder 10 and subject to a recuperator spring 12.

Coupling point 8 is located on ramming lever 6 in such a way that the ratio of the distance of positioning roller 7 at the free end of the lever from coupling point 8 to the distance of coupling point 8 from the pivot 9 is approximately 5:1. This ratio is the stroke-to-stroke transmission ratio of ramming lever 6.

The inlet 15 into pneumatic cylinder 10 communicates with a compressed-air reservoir 19 through a rapid-opening control valve 17 with an electromagnetic activating component 18. Compressed-air reservoir 19 in turn communicates with a source 21 of compressed air through another control valve 20 with an electromagnetic activating component 22.

The outlet 16 from pneumatic cylinder 10 can be connected to the outside air through a third control valve 25 with an electromagnetic activating component 26.

Electromagnetic activating components 18, 22, and 26 are part of an electric control circuit. Activating component 18 can be turned on with a switch 24, activating component 22 with a switch 23, and activating component 26 with a switch 27.

The function of the flick rammer illustrated in FIGS. 1 through 3 will now be specified.

With the rammer in the starting position illustrated in FIG. 1, a round A is placed in loading tray 2 either manually or by means of a loading mechanism. The free end of ramming lever 6 is behind the round and positioning roller 7 rests against the base of the round.

Switch 23 is turned on (not shown) and compressed-air reservoir 19 is charged with air through control valve 20. Switch 23 is turned off and switch 24 is turned on, opening control valve 17 through electromagnetic activating component 18 and suddenly introducing compressed air into pneumatic cylinder 10. Piston 11 moves up rapidly. When the piston arrives the end of its stroke, the pressures in compressed-air reservoir 19 and in pneumatic cylinder 10 will be become equal. The motion of piston 11 will be transmitted to ramming lever 6, subjecting tie rod 13 to tension and preventing it from buckling. Ramming lever 6 will transmit its moment to the round A in loading tray 2, and the round will begin moving toward powder chamber 3. This situation is illustrated in FIG. 2, wherein round A is in powder chamber 3 and floating free toward conical section 4. The articulation 14 between tie rod 13 and piston 11 compensates for any lateral deviation in the motion of ramming lever 6.

FIG. 3 illustrates the final stage of the ramming procedure. Round A has traveled through powder chamber 3 and its soft-metal positioning ring is jammed in conical section 4.

Switch 27 simultaneously turns on while switch 24 turns off, opening control valve 25 through activating component 26 and evacuating the air from pneumatic cylinder 10. Piston 11 returns to its original position subject to recuperator spring 12.

The pivot 9 of the ramming lever 6 in the embodiment of the flick rammer illustrated in FIGS. 1 through 3 is in a plane E1 that extends perpendicular to the longitudinal axis L of loading tray 2 and between the front and rear of the tray. The pivot is at a prescribed distance from longitudinal axis L. Ramming lever 6 extends out of plane E1 and into another plane E2 that extends at the rear of loading tray 2 perpendicular to longitudinal axis L. Ramming lever 6 is bent where it enters plane E2, and its free end 6*a* extends essentially within that plane. As will be evident from FIG. 3, this design is of advantage in that the rear end 1 of the recoiling barrel can travel back in the direction indicated by arrow R to the position indicated by the broken line in FIG. 3, while the shell is ejected, without being obstructed by ramming lever 6.

As will be evident from the figures, the flick rammer in accordance with the invention consists of very few components that are compactly arranged. This provides the potential for redundancy, with two identically designed flick rammers positioned very close together in association with one barrel.

The pneumatic cylinder in the embodiment illustrated in FIGS. 1 through 3 is a piston cylinder. A pneumatic diaphragm cylinder could also be employed instead to make the device even more responsive.

It will be appreciated that the instant specification and claims are set forth by way of illustration and not limitation, and that various modifications and changes may be made without departing from the spirit and scope of the present invention.

What is claimed is:

1. In a flick rammer for loading an artillery round into a powder chamber of a barrel, having a loading tray positioned in alignment with the powder chamber at a prescribed distance to the rear thereof and receptive of said round, a mechanical acceleration component for engaging the rear of said round in the powder chamber and drive means connected to the mechanical acceleration component, the improvement wherein the drive means comprises a pneumatic cylinder, a compressed-air reservoir receptive of a supply of compressed air, a rapid-opening control valve for connecting the reservoir and the cylinder, a moving component associated with the cylinder and means connecting the mechanical acceleration component to the moving component of the pneumatic cylinder including a stroke-transmission mechanism with an input to output transmission ratio greater than 1, wherein the cylinder has a maximum permissible pressure and wherein the compressed-air reservoir has a sufficiently high supply pressure such that when the control valve is open and the same pressure prevails in both the reservoir and the cylinder, the pressure therein will be the maximum permissible cylinder pressure.

2. The flick rammer as in claim 1, wherein the transmission ratio is at least 5:1.

3. In a flick rammer for loading an artillery round into a powder chamber of a barrel, having a loading tray positioned in alignment with the powder chamber at a prescribed distance to the rear thereof and receptive of said round, a mechanical acceleration component for engaging the rear of said round in the powder chamber and drive means connected to the mechanical acceleration component, the improvement wherein the drive means comprises a pneumatic cylinder, a compressed-air reservoir receptive of a supply of compressed air, a rapid-opening control valve for connecting the reservoir and the cylinder, a moving component associated with the cylinder and means connecting the mechanical acceleration component to the moving component of the pneumatic cylinder including a stroke-transmission mechanism with an input to output transmission ratio greater than 1, wherein the mechanical acceleration component comprises a ramming lever pivoted at one end and having a free end for contacting the round in the loading tray, wherein the lever is secured at a prescribed coupling point to the moving component of the pneumatic cylinder, with the ratio of the distance of the free end of the lever from its pivot to the distance of the coupling point from the pivot determining the transmission ratio, wherein the coupling point of the ramming lever is positioned in a first plane perpendicular to a longitudinal axis of the loading tray and between the front and rear end of the tray at a prescribed distance from that axis, and the ramming lever extends out of the first plane into a second plane perpendicular to the longitudinal axis of, and behind, the tray and the ramming lever has a section adjacent its free end that extends essentially within the second plane.

4. The flick rammmer as in claim 3, further comprising a tie rod and an articulation securing the ramming lever to the moving component of the pneumatic cylinder.

5. The flick rammer as in claim 4, wherein the pneumatic cylinder is positioned in relation to the ramming lever to apply tension to the tie rod when the moving component moves.

* * * * *